United States Patent [19]

Flannigan

[11] Patent Number: 4,622,868

[45] Date of Patent: Nov. 18, 1986

[54] TOOL USED TO MANUALLY LOCK AND UNLOCK A PASSENGER DOOR OF A MOTOR VEHICLE

[76] Inventor: Bryan W. Flannigan, 163 Hahn Avenue, Cambridge, Ontario, Canada, N3C 3B2

[21] Appl. No.: 718,492

[22] Filed: Apr. 1, 1985

[30] Foreign Application Priority Data

Apr. 11, 1984 [CA] Canada ..... 451777

[51] Int. Cl.[4] ..... B25B 33/00

[52] U.S. Cl. ..... 81/15.9

[58] Field of Search ..... 81/15.9, 488, 3.55; 29/278; 254/131, 21, 22, 25; 294/19.1, 26, 2, 24; 7/167

[56] References Cited

U.S. PATENT DOCUMENTS

| | | | |
|---|---|---|---|
| 486,300 | 11/1892 | Scheid | 254/25 |
| 2,330,893 | 10/1943 | Hutaff, Jr. | 81/3.55 |
| 3,218,653 | 11/1965 | Colo'ne | 7/167 |
| 3,713,200 | 1/1973 | Burns | 254/131 X |
| 3,819,221 | 6/1974 | O'Connor | 81/15.9 X |
| 4,248,465 | 2/1981 | Halstead | 81/488 |
| 4,399,683 | 8/1983 | Hunter | 81/15.9 X |

*Primary Examiner*—Frederick R. Schmidt
*Assistant Examiner*—Debra S. Meislin
*Attorney, Agent, or Firm*—Daryl W. Schnurr

[57] ABSTRACT

A tool that can be used to manually lock and unlock a passenger door of a motor vehicle from the driver's seat of said vehicle has an elongated handle and a head. The head has two channels and a hook that can be used to lock or unlock different types of locking mechanisms on passenger doors.

8 Claims, 7 Drawing Figures

44
46
42
40
35
38
4
40
6
33
31
28
26
12
29
18
12

46
4
35
34
6
26
12
45

44
42
42
4
36
35
32
40
26
28
6
33
24
31
29
18
4

35
4
34
4

4
34

TOOL USED TO MANUALLY LOCK AND UNLOCK A PASSENGER DOOR OF A MOTOR VEHICLE

BACKGROUND OF THE INVENTION

1. Field of the Invention

This invention relates to a tool that can be used to lock and unlock a door on a motor vehicle. In particular, this invention relates to a tool for manually locking, unlocking or opening a passenger door of a motor vehicle from a position in the driver's seat of the vehicle.

2. Description of the Prior Art

Unless a motor vehicle is equipped with electrically operating door locks, it is generally difficult for a driver of a motor vehicle to lock or unlock a passenger door while occupying the seat normally occupied by the driver. This can be particularly difficult when the driver is wearing a seatbelt that includes a shoulder strap. Often, the driver desiring to unlock a passenger door must first remove his seatbelt. The driver must then move from the driver's seat closer to the door to be unlocked or the driver must stretch and lean in an attempt to reach the lock of a passenger door. While electrically operated door locks work well, they are not in common usage as they are not standard equipment on most motor vehicles and they are a relatively expensive option, particularly when compared to the present invention.

It is an object of the present invention to provide a tool which can be used by a driver of a motor vehicle to lock and unlock a passenger door of a motor vehicle while remaining comfortably in the driver's seat and fastened by a seatbelt including a shoulder strap.

SUMMARY OF THE INVENTION

A tool, in accordance with the present invention, has an elongated handle and a head. The head has a top, base and two sides and is located at one end of said handle and affixed to said handle at said base. The top is located opposite said base and a symmetrical channel extends from the top towards said base. The symmetrical channel has a cross-section in the form of two adjacent overlapping circles, an outer circle and an inner circle. The outer circle has a slightly larger diameter than the inner circle. There is a U-shaped channel located at one side of said head and a hook located at the other side.

BRIEF DESCRIPTION OF THE DRAWINGS

In drawings, which illustrate a preferred embodiment of the invention.

DESCRIPTION OF A PREFERRED EMBODIMENT

Figure 1:
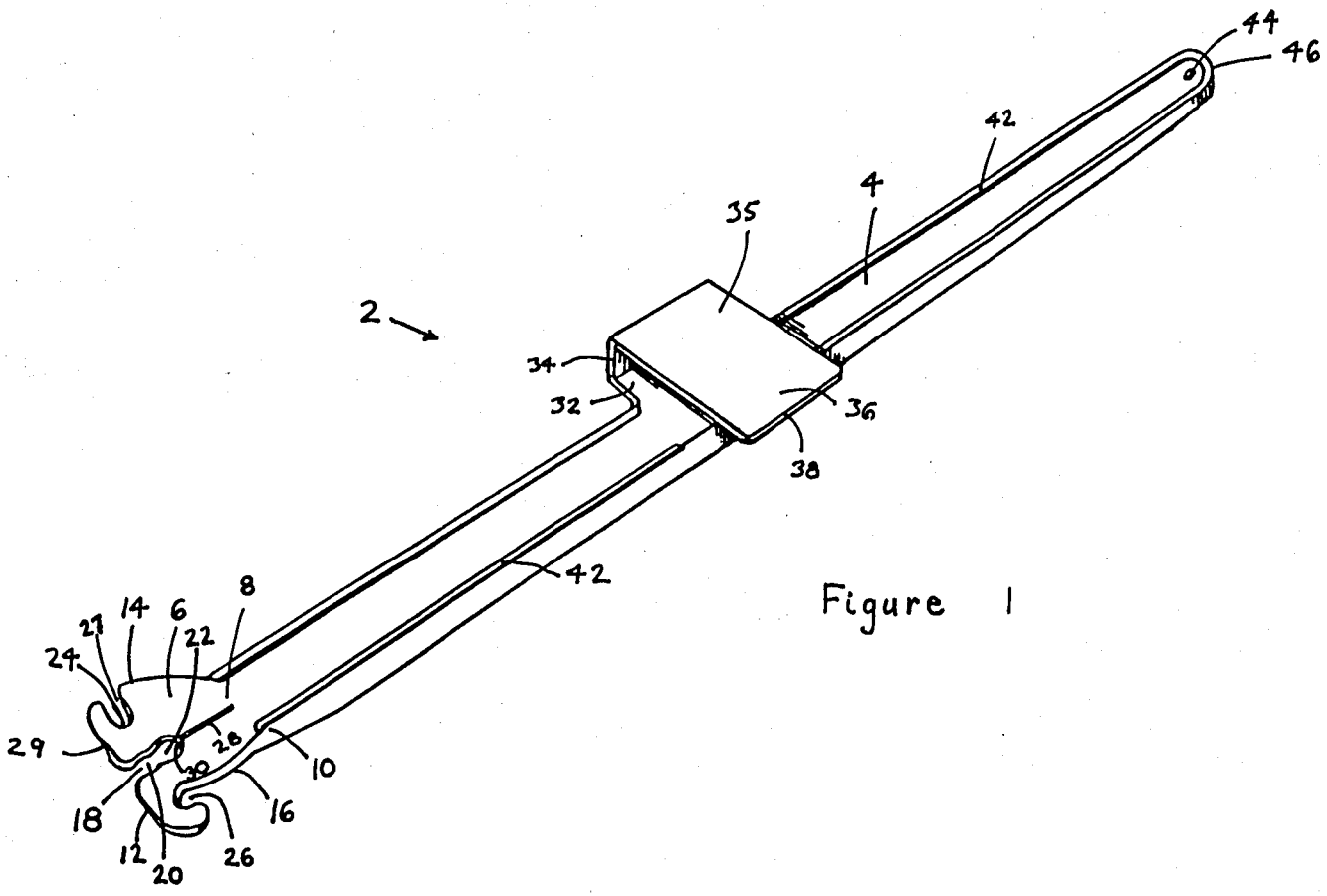
FIG. 1 is a perspective view of a tool of the present invention.

Referring to the drawings in greater detail, in FIG. 1, a tool 2 has a handle 4 and a head 6. The head 6 has a base 8 and is located at an end 10 of the handle 4. The head 6 is affixed to said handle 4 at said base 8. Preferably, the head 6 is an integral part of the tool 2. The tool 2 of this particular embodiment is made from plastic and is molded as one unit. The head 6 has a top 12 located opposite to said base 8 and two sides 14, 16. A symmetrical channel 18 extends from said top 12 toward said base 8. The channel 18 has a longitudinal cross-section in the form of two adjacent and overlapping circles, one of said circles being an outer circle 20 and the other of said circles being an inner circle 22. The outer circle 20 has a slightly larger diameter than said inner circle 22. At one side 14 of said head, there is located a U-shaped channel 24. At the other side 16 of said head 6, there is located a hook 26.

A slit 28 is symmetrical with said channel 18 and extends from an inner edge 30 of said inner circle 22 towards said base 8. The U-shaped channel 24 is substantially normal to the symmetrical channel 18. The U-shaped channel 24 is slightly narrower at its entrance 27 than in the remainder of said channel. An indentation 29 located in the top 12 adjacent to the channel 24 allows an edge 31 of the channel 24 to be slightly flexible. The edge 31 is located adjacent to the top 12 and is slightly flexible in that said edge will move further away from an opposite edge 33 when sufficient pressure is exerted on said edge 31. Thus, the channel 24 will become slightly larger as pressure is exerted on edge 31. When the pressure is removed, the edge 31 will return to its original position.

Approximately midway along the length of the tool 2, there is affixed to the handle 6 a clip 35. The clip 35 has a tab 32 that extends from one side of the handle 4. A flange 34 is perpendicular to the tab 32 and extends away from said handle 4. An outer plate 36 is normal to the flange 34 and parallel to the tab 32. The plate 36 extends beyond the handle 4 to define a U-shaped space with the flange 34, tab 32 and part of the handle 4. An edge 38 of the plate 36 extends beyond the handle 4 so that the clip 35 can be inserted over any suitable objects to support the tool 2 when it is not in use. For example, the clip 35 can be mounted on a sun visor of a motor vehicle in which the tool is located.

Figures 2, 3, 4, 5, 6, 7:
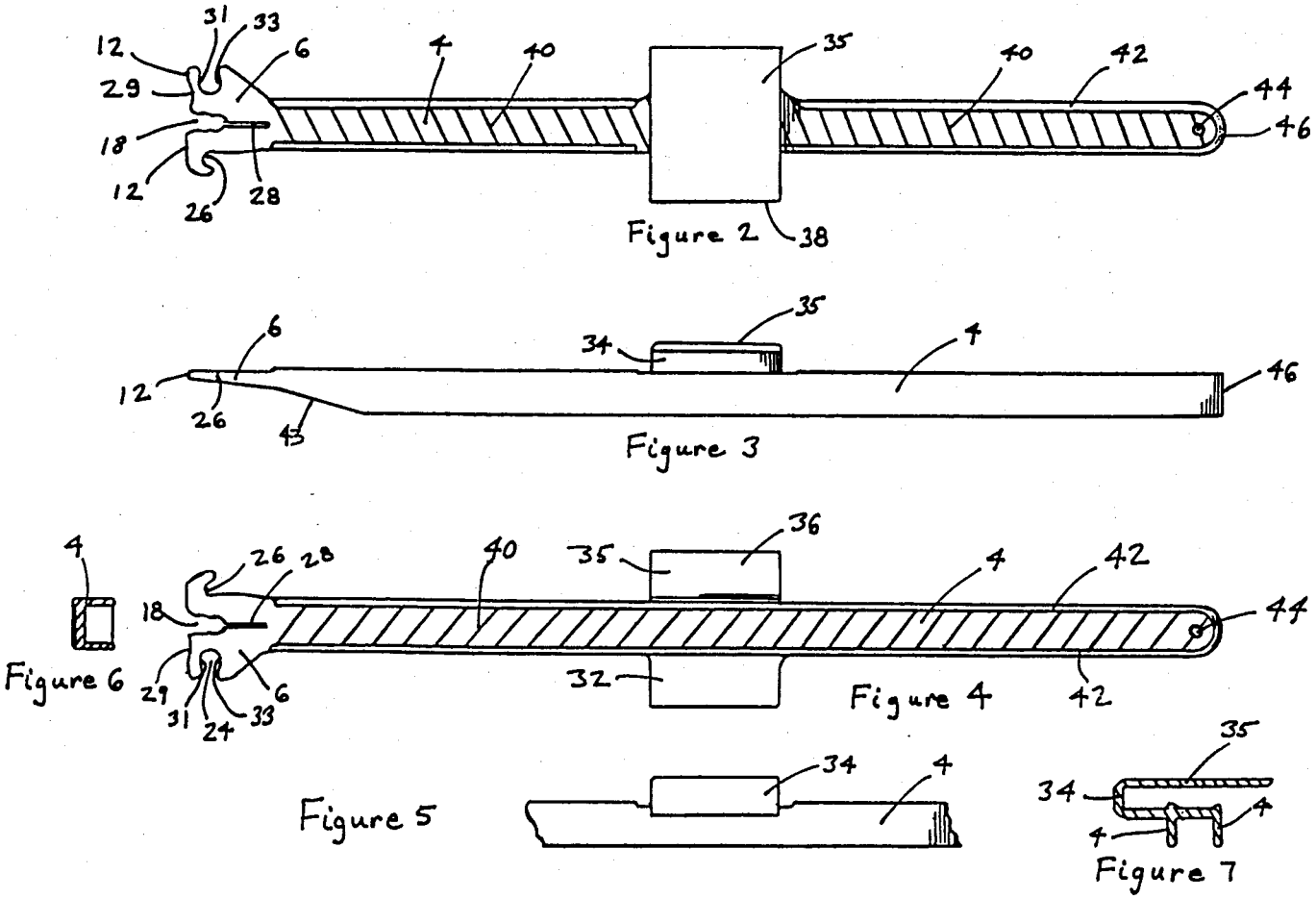
FIG. 2 is a top view of said tool.
FIG. 3 is a side view of said tool.
FIG. 4 is a rear view of said tool.
FIG. 5 is a partial side view of said tool from a side opposite to that shown in FIG. 3.
FIG. 6 is a cross-sectional view of a handle of said tool.
FIG. 7 is a cross-sectional view of a handle and clip of said tool.

As shown in FIGS. 2 and 4, there are a series of transverse, diagonal reinforcing ribs 40 located on a top side and a rear side of the handle 4. Along a periphery of each of the top and rear sides of the handle 4, there extends a lip 42. The two lips 42 and the series of ribs 40 add strength to the handle 4. As shown in FIG. 6, the handle 4 has a U-shaped cross-section. In FIG. 7, the cross-sectional view of the handle 4 and clip 35 is shown. For convenience, an opening 44 is located in an end 46 of the handle 4. The opening 44 can be used to hang the tool 2 on a nail (not shown) when it is not in use.

As shown in FIG. 3, the head 6 is tapered from the base 8 to the top 12. Also, an end portion 43 of the handle 4 is tapered to the base 8 of the head 6. The purpose of tapering the head and the handle is to make the tool easier to manipulate in the area of a lock on a passenger door.

In use, the tool is held by the handle in one hand of the user. An appropriate part of the head is placed in contact with a lock on a passenger door of a motor vehicle and the tool is manually manipulated to either lock or unlock said passenger door, as desired by the user. It has been found that the symmetrical channel 18 can be used to open or lock a passenger door on most motor vehicles. This channel is used with locks of the type having a small cylinder that can be moved up and down to unlock and lock a passenger door. When the cylinder has a relatively large diameter, it can be moved up or down by placing it in the outer circle of the symmetrical channel 18. When the cylinder has a relatively small diameter, it can be moved up and down by placing it in the inner circle of the symmetrical channel 18. The purpose of the slit 28 is to allow the symmetrical channel to expand slightly as the cylinder is inserted into it and thereby grip the cylinder. When the cylinder has been gripped, it can be move up and down as desired. The hook 26 can be used to open and close the locks on passenger doors of many vehicles that have rectangular posts that must be raised from the side in order to unlock said door. These types of locks are found on many vehicles manufactured in Japan.

The U-shaped channel 24 can be used to open and close the lock on the passenger door of a MAZDA (a trade mark) vehicle or vehicles having similar locks to those on a MAZDA vehicle. Most MAZDA vehicles have a rectangular post in the interior of the vehicle on each door. The post must be lifted up to an unlocked position and pushed down to a locked position. A circular depression is located on each of two sides of said rectangular post, one depression being located on a first side immediately adjacent to a window and a second depression on a side opposite to said first side. In normal use, these depressions are designed to receive fingers of a person who desires to open or lock the vehicle from the inside. When the tool 2 is used to open a passenger door of a vehicle having this type of lock, the U-shaped channel 24 is manipulated from the side of the rectangular post and forced towards the circular depressions. Since the post is wider near the edge than at the depressions, the edge 31 will be forced apart from the edge 33 as the relatively narrow open end of the channel is forced over one of the sides of the post. However, when the open end of the channel is located in the circular depressions, the channel 24 will return to its original position. From this point, the rectangular post can either be raised or lowered as desired. When that has been accomplished, the tool 2 can be further manipulated to disengage the channel 24 from the rectangular post. In some motor vehicles, the lock on a passenger door will open as soon as the handle that normally opens the entire door is manipulated so that the door opens. In these motor vehicles, it is usually possible to use either the hook or the U-shaped channel to pull on the handle that opens the car door, thereby automatically opening the lock and the door in one step. Also, some vehicles have a door lock that slides back and forth on the handle of the door to be locked or unlocked. These can be opened easily using the tool 2 to push to door lock to the open or closed position, as desired. Alternatively, the hook 26 or the symmetrical channel 18 can usually be used conveniently.

While various sizes of the tool 2 will be suitable, it has been found that a took having an overall length of approximately 35 cm is a suitable size to accomplish the purposes of the present invention.

While the tool of the present invention will mainly be used to open a passenger door in the front seat of a motor vehicle, it can also be used to open the rear passenger doors in some vehicles. The length of the handle will allow the driver of a motor vehicle to open or lock the passenger doors without unfastening his seatbelt or moving from the driver's seat.

While the tool of the present invention can be made of various materials, it is preferably made of a suitable molded plastic that is rigid enough so that it can be used in the manner indicated yet flexible enough so that it will not break easily. Further, the plastic material should be resilient so that the tool will return to its original shape when it is not in use. Variations within the scope of the attached claims will be readily apparent to those skilled in the art. For example, the indentation 29 could be located in the edge 31 of channel 24 rather than in the top 12 to accomplish the same result. As an alternative, the U-shaped channel 24 could simply be located close enough to the top 12 so that the edge 31 is flexible or moveable yet rigid enough to return to its initial position when there is no external force exerted on it.

The tool of the present invention will be particularly useful when a passenger is being picked up by a driver of a motor vehicle. The driver will be able to remain in the driver's seat with a seatbelt on and the car engine running. The passenger door can be unlocked by the driver using the tool of the present invention, while the driver remains in the driver's seat. This method is not only more convenient, it is safer.

What I claim as my invention is:

1. A tool for manually unlocking a door of a motor vehicle from an inside of said vehicle, said tool comprising an elongated handle and a head, said head having a top, base and two sides and being located at one end of said handle, said head being affixed to said handle at said base, said channel having a longitudinal cross-section in the form of two adjacent and overlapping circles, an outer circle and an inner circle, said outer circle having a slightly larger diameter than said inner circle, with a U-shaped channel located at one side of said head and a hook located at the other side of said head, a slit that is symmetrical and said symmetrical channel extends through said head from said inner circle towards said base so that said symmetrical channel can expand slightly when pressured.

2. A tool as claimed in claim 1 wherein the U-shaped channel has one flexible edge so that said channel is expandable.

3. A tool as claimed in claim 2 wherein the symmetrical channel is substantially normal to the U-shaped channel.

4. A tool as claimed in claim 3 wherein an end portion of the handle near the head and head itself are tapered to the top of said head.

5. A tool as claimed in claim 4 wherein the handle has a series of transverse, diagonal reinforcing ribs.

6. A tool as claimed in claim 3 wherein there is a clip affixed to said handle so that said tool can be readily attached to a support when not in use.

7. A tool as claimed in claim 3 wherein the handle has a U-shaped cross-section and the tool is made of plastic.

8. A tool as claimed in claim 3 wherein the handle is straight.

* * * * *